US005465645A

United States Patent [19]

Cominolli

[11] Patent Number: 5,465,645

[45] Date of Patent: Nov. 14, 1995

[54] RECOIL BUFFER FOR SEMI-AUTOMATIC PISTOL

[76] Inventor: Joseph E. Cominolli, 624 Cherry Rd., Syracuse, N.Y. 13219

[21] Appl. No.: 325,614

[22] Filed: Oct. 19, 1994

[51] Int. Cl.[6] ..... F41C 3/00

[52] U.S. Cl. ..... 89/198; 89/196

[58] Field of Search ..... 89/196, 198, 163; 411/359

[56] References Cited

U.S. PATENT DOCUMENTS

| | | | |
|---|---|---|---|
| 1,425,182 | 8/1922 | Dubbs | 411/539 |
| 3,901,125 | 8/1975 | Raville | 89/163 |
| 4,522,107 | 6/1985 | Woodcock et al. | 89/196 |
| 4,754,689 | 6/1988 | Grehl | 89/196 |
| 4,907,489 | 3/1990 | Teague | 89/14.5 |
| 4,972,760 | 11/1990 | McDonnel | 89/196 |
| 5,069,110 | 12/1991 | Menck | 89/198 |
| 5,076,139 | 12/1991 | Hiett | 89/198 |

*Primary Examiner*—Charles T. Jordan
*Assistant Examiner*—Christopher K. Montgomery
*Attorney, Agent, or Firm*—Charles S. McGuire

[57] ABSTRACT

A recoil buffer for a semi-automatic pistol having conventional, relatively moveable slide and frame with opposing abutment surfaces limiting rearward movement of the slide in response to firing the pistol. The recoil buffer is a layer of firmly resilient material mounted in covering, contacting relation to the frame abutment surface. The layer of material is disclosed in the form of a washer mounted upon a portion of the slide return spring guide rod. In one embodiment, the washer has a through cut to permit its radial insertion over a stem portion extending between flange and head portions, and the recoil buffer may include a second, resilient washer axially inserted on the guide rod to be positioned against the forward surface of the flange, for contact by the slide abutment surface in the rearward position of the slide. In a further embodiment, the washer is axially inserted on a stem extending rearwardly from the guide rod flange.

15 Claims, 2 Drawing Sheets

RECOIL BUFFER FOR SEMI-AUTOMATIC PISTOL

BACKGROUND OF THE INVENTION

The present invention relates to structure for preventing damage to semi-Automatic pistols caused by forceful impact of relatively moveable portions each time firing occurs, and reducing discernable recoil and shock to the Shooter.

In a common type of semi-Automatic-pistol, a slide is mounted for rearward movement with respect to a frame by the recoil force associated with firing a bullet. A coil spring, mounted upon and guided by an elongated rod, is compressed by rearward movement of the slide and the latter is returned to its forward position by expansion of the spring. Movement of the slide serves to eject the casing, and to cock the gun and place a new round in the chamber for the next firing. The rearward position of the slide is defined by contact of an abutment surface thereon with a surface fixed with respect to the frame, such contact occurring with a high impact force transmitted by the slide to the frame.

In order to reduce the occurrence of damage to the slide and/or frame due to repeated, forceful impact of opposing surfaces, recoil buffering means have been provided in a number of forms. Many of such buffering means comprise structure mounted upon or otherwise associated with the spring guide rod, including those disclosed in U.S. Pat. Nos. 3,901,125 of Raville, 4,522,107 of Woodcock et al, 4,667,566 of Bosshard et al, and 4,754,689 of Grehl. However, it has been found that even in pistols equipped with such recoil buffering means, cracking of the frame and/or the slide often occurs after repeated firing, requiring relatively expensive repair or replacement of the frame or slide.

The principal object of the present invention is to provide a recoil buffering means which is effective to prevent or reduce the occurrence of damage to semi-automatic pistols due to recoil impact.

Another object is to reduce discernable recoil and shock to the shooter, which in turn allows for more rapid and accurate follow-up shots.

A further object is to provide an inexpensive, yet highly effective recoil buffer which may be easily and quickly mounted upon and removed from various models of semi-automatic pistols.

Other objects will in part be obvious and will in part appear hereinafter.

SUMMARY OF THE INVENTION

The recoil buffering means of the present invention may be incorporated in a variety of conventional semi-automatic pistols having the usual, relatively moveable slide and frame with opposing abutment surfaces. The present invention is distinguished from the prior art by provision of a layer of resilient, impact-absorbing material in overlying, directly contacting relation with the abutment surface of the frame. In a first described embodiment, a flange and stem portion are integrally formed with and extend radially and axially outwardly, respectively, from the rear end of the recoil spring guide rod. A circular head portion, of larger diameter than the stem, is formed integrally with and at the rear end of the stem portion. A washer of resilient, impact-absorbing material is mounted between the flange and head portion, surrounding the stem portion. A through cut from the central opening to the outer periphery of the washer permits radial mounting thereof on the stem. Optionally, a second such washer may be mounted forwardly of the flange. In another embodiment, there is no head portion, permitting axial mounting of the washer, without necessity of a cut therein, upon the stem.

When the guide rod is mounted in its usual position, the washer mounted upon the stem or on the head portion is in covering, contacting relation to the abutment surface of the frame. When the slide is moved to its rearward position, the abutment surface thereof contacts the flange at the rear end of the guide rod (or the washer mounted forwardly of the flange) and the impact is transmitted to the abutment surface of the frame directly through the resilient washer on the stem portion. This arrangement effectively prevents damage to the pistol's components due to recoil impact.

DETAILED DESCRIPTION

Figure 1:
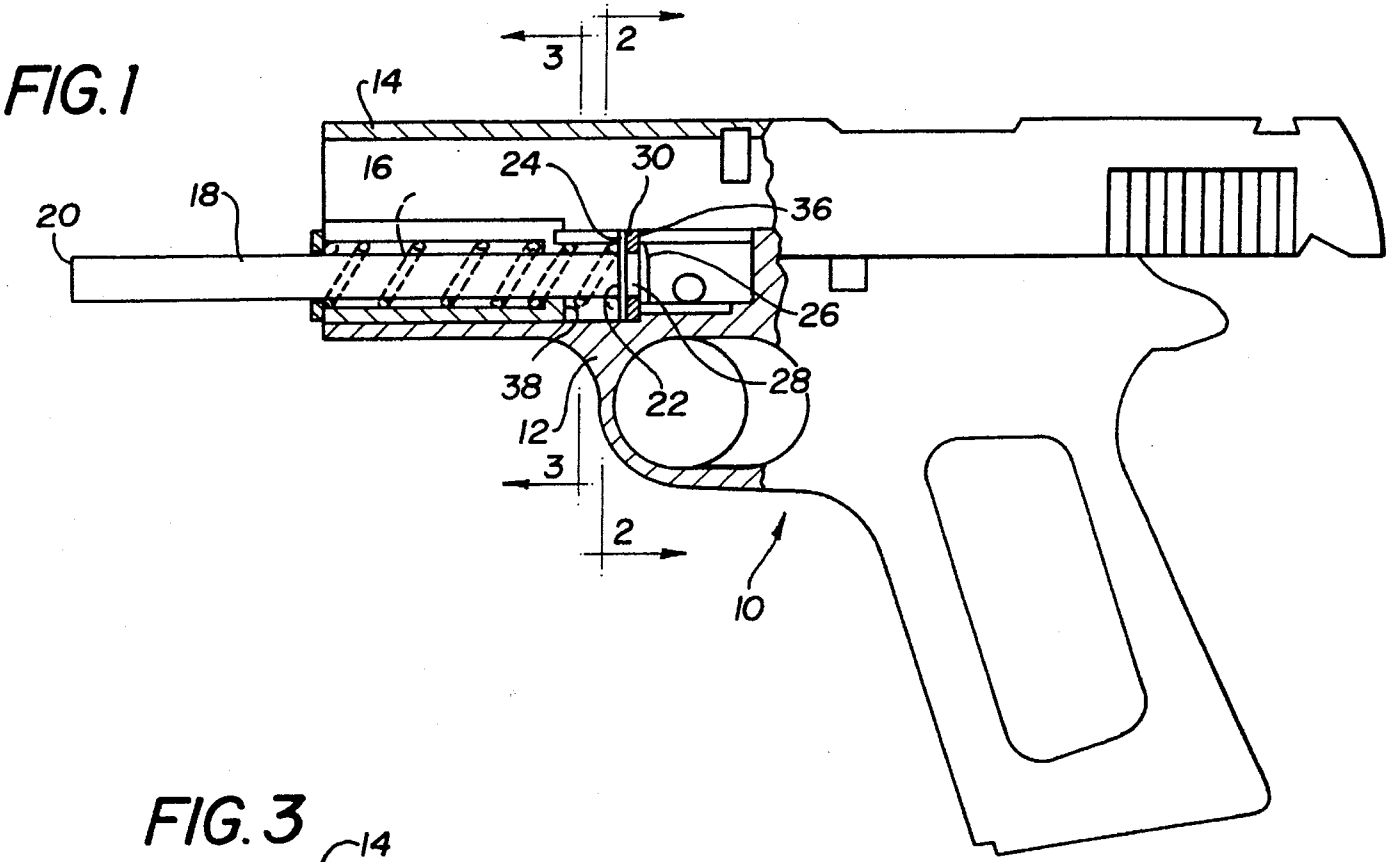
FIG. 1 is a side elevational view of an exemplary form of semi-automatic pistol incorporating the recoil buffering means of the present invention.
Figure 3:
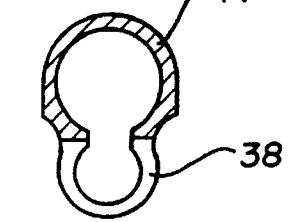
FIGS. 2 and 3 are elevational views taken on the lines 2—2 and 3—3, respectively, of FIG. 1 showing the abutment surfaces of the handgun frame and slide, respectively.
Figure 2:
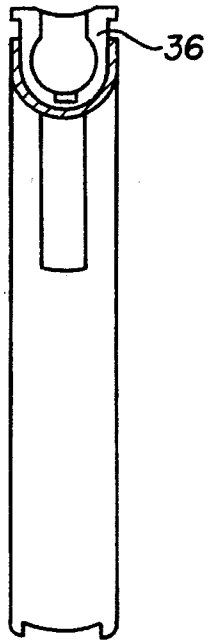

The present invention comprises an assembly of parts for incorporation with a semi-automatic pistol of otherwise conventional design. Therefore, to avoid unnecessary description of conventional features of the firearm, only those portions which interact directly with elements of the present invention will be specifically referred to in the present description. The handgun shown in FIGS. 1–3 is a 0.45 caliber, semi-automatic pistol, but it will be understood that the invention may be employed in other firearms having a slide moveable from forward to rearward positions in response to firing, the rearward position being defined by contact of an abutment surface on the slide with the frame or other structure mounted thereon, and the slide being returned to the forward position by a recoil spring.

Referring now to the drawings, pistol 10, in addition to other conventional components, includes frame 12 and slide 14. In a well-known construction of such firearms, frame 12 and slide 14 include longitudinal tracks and grooves on each side which maintain the two pieces in sliding engagement during rearward and forward movement of the slide. Coil spring 16 is positioned with its opposite ends abutting portions of the frame and slide, respectively, or other structure fixed with respect to the frame and slide, whereby the spring is compressed by rearward movement of the slide in response to firing of the pistol and expands to return the slide to the forward position. Spring 16 encircles and is guided during compression and expansion by guide rod 18. In accordance with conventional practice, rod 18 may be provided in a single piece or in a plurality of threadedly connected, axially separate sections, depending upon the manner of assembly of the guide rod and spring with the other gun components. Also, various models of pistols are designed for use with guide rods of different lengths. The guide rod is usually metal, but may be of rigid, high-impact plastic.

Figure 4:
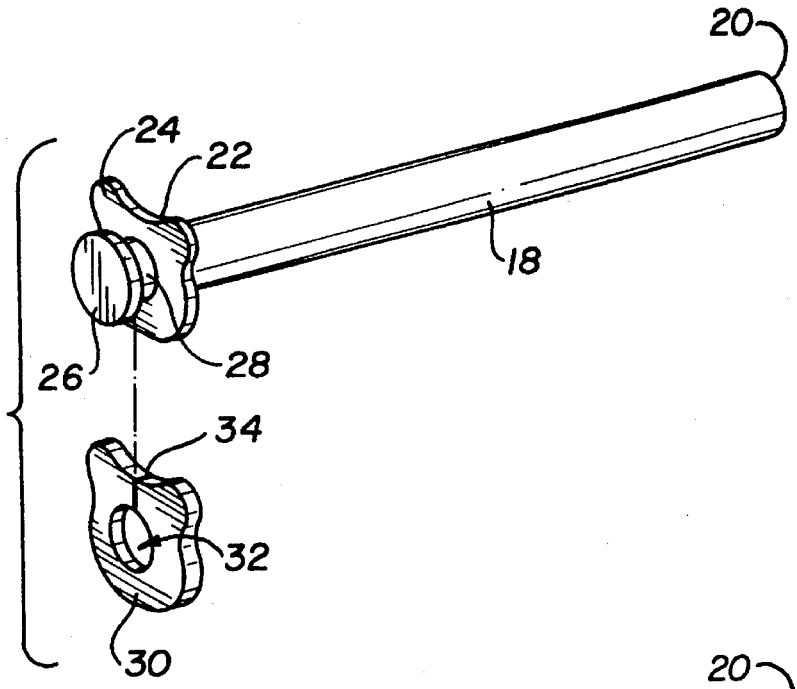
FIGS. 4 and 5 are perspective views, in exploded and assembled conditions, respectively, of a first embodiment of the guide rod and impact buffering means of the present invention.
Figure 5:
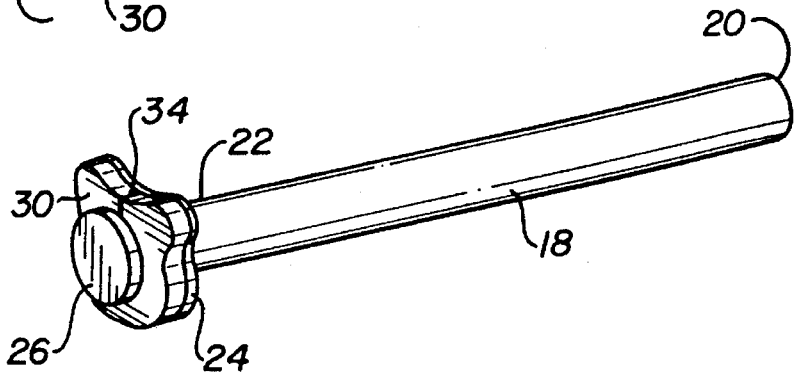
Figure 6:
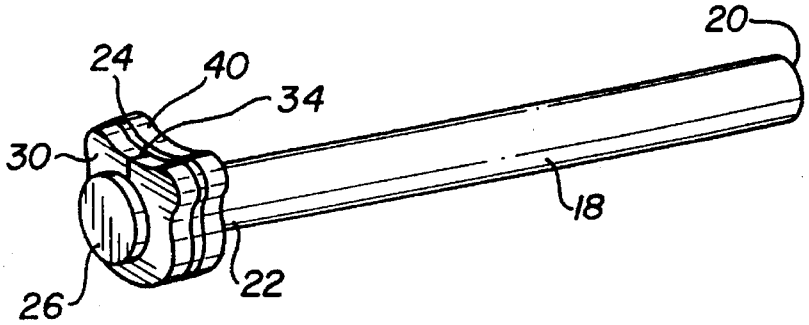
FIGS. 6 and 7 are perspective views of an alternate embodiment.

In FIGS. 4–6 rod 18 is shown together with other, integral portions and a separate element for assembly therewith. Rod 18 has front and rear ends 20 and 22, respectively, with flange 24 extending radially outwardly at rear end 22. Head portion 26 is attached by stem portion 28 to rear end 22 of rod 18. All of rod 18, flange 24, head portion 26 and stem portion 28 are preferably integrally formed or permanently attached and of alloy steel, stainless steel, aluminum or other suitable material. Stem portion 28 may have a diameter less than or equal to or larger than the diameter of rod 18.

Washer 30 is of firm, yet somewhat resilient and pliable material, having a peripheral outline substantially corresponding to that of flange 24. The thickness of washer 30 is sufficient, consistent with the particular material used, to absorb the recoil energy to an extent preventing damage to both the frame and slide. For example, a washer of neoprene having a thickness of about 0.090" has been found satisfactory. Washer 30 has circular opening 32 and may be solid or have a through cut 34 extending from opening 32 to the periphery of the washer, permitting assembly of the washer with stem portion 28 by spreading the washer at cut 34 and pushing it over the stem portion so that opening 32 surrounds the stem portion. Washer 30 is thus positioned between the rearwardly facing surface of flange 24 and the forwardly facing surface of head portion 26, the thickness of the washer being substantially equal to the linear distance between these two surfaces. The thickness of washer 30 is preferably slightly larger than the distance between opposing surfaces of flange 22 and head portion 26 to provide a slight interference fit.

The assembly consisting of washer 30, rod 18 and elements integral therewith is positioned in operative relation with frame 12 by placing the rearwardly facing surface of washer 30 in covering, contacting relation to generally U-shaped abutment surface 36, with head portion 26 extending into and closely surrounded by the recess surrounded by surface 36, as shown in FIG. 1. Rod 18 extends into the annular space defined by the forwardly extending portion of the frame, with the longitudinal axis of the rod substantially parallel to the axis of the gun barrel. Spring 16 is placed in encircling relation to rod 18 with opposite ends of the spring retained between relatively moveable surfaces associated with the frame and slide, respectively.

Upon firing, the recoil force is transmitted to slide 14, causing rearward movement thereof to a position defined by contact of abutment surface 38 with flange 24. The impact of surface 38 with flange 24 is transmitted through washer 30 to abutment surface 36. The cushioning effect of washer 30 and its direct contact with abutment surface 36 prevents the eventual cracking or other damage to frame 12 and slide 14 commonly resulting in prior art handguns from repeated, forceful, contact of metal or other rigid surfaces with the frame abutment surface. Slide 14 is returned to its forward position by expansion of spring 16. Also, a significant, discernable reduction in transmission of recoil shock to the hand of the firer is achieved.

If desired, a second, cushioning washer 40 may be placed forwardly of flange 24, as shown in FIG. 6, to prevent contact of abutment surface 38 of slide 14 with metal flange 24. Since washer 40 may be axially inserted directly over forward end 20 of rod 18, it is unnecessary to cut washer 40 between its central opening and outer periphery, as in the case of washer 30 which must be radially inserted over stem portion 28. It has been found, however, that the provision of a single cushioning washer in covering relation to the frame abutment surface is effective to prevent damage to both the slide and to the frame.

Figure 7:
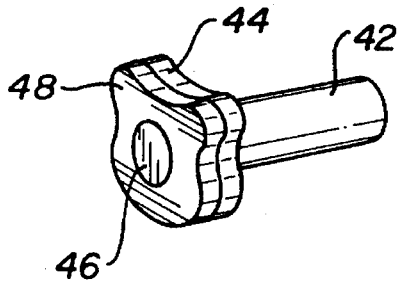

In FIG. 7 is shown a further embodiment, employing a shorter guide rod 42, of a type conventionally employed in certain designs of semi-automatic pistols. Flange 44 and rearwardly extending stem portion 46 are integrally formed with rod 42. Washer 48, of the same resilient, impact-absorbing material as washers 30 and 40, has a central opening for axial insertion of washer 48 on stem 46. The length of stem 46 may be substantially equal to the thickness of washer 48, as illustrated, or may be longer or slightly smaller than the washer thickness. In any event, when rod 42 is installed in its conventional position in the pistol, washer 48 is in covering, contacting relation to the frame abutment surface, with the previously described beneficial results.

What is claimed is:

1. In a live-fire, semi-automatic pistol having a frame with a first abutment surface, a slide with a second abutment surface, said slide being moveable from a forward to a rearward position wherein impact is delivered to said first abutment surface in response to firing said pistol, a coil spring compressible by movement of said slide to said rearward position and expansible to return said slide to said forward position, and a guide rod having front and rear ends, a stem extending axially from said rear end and a flange having forward and rear surfaces, said flange extending radially outwardly from said rear end, the improvement consisting of first and second annular washers of resilient, impact-absorbing material mounted in encircling relation to said stem and said rod in contact with said rear and forward surfaces of said flange, respectively, said first washer further being disposed in covering, contacting relation to said first abutment surface, whereby upon movement of said slide to said rearward position said impact is delivered to said first abutment surface through said first and second washers.

2. The improvement of claim 1 and further including a head portion affixed to said stem portion, said head portion having a diameter larger than that of said stem portion and a forward surface parallel to and spaced a predetermined distance from said rear surface of said flange portion.

3. The improvement of claim 2 wherein said second washer has a thickness substantially equal to said predetermined distance.

4. The improvement of claim 2 and further including a through cut in said second washer to permit spreading at said cut and radial insertion of said second washer on said stem portion.

5. The improvement of claim 1 wherein each of said first and second washers and said flange portion have substantially coextensive peripheral outlines.

6. The improvement of claim 2 wherein said stem and said head portion have diameters respectively smaller and larger than the diameter of said rod.

7. The improvement of claim 6 wherein said second washer has an opening with a diameter substantially equal to the diameter of said stem portion.

8. The improvement of claim 7 wherein said flange, stem and head portions are formed integrally with said rod.

9. The improvement of claim 1 wherein said second abutment surface impacts directly against said flange forward surface upon movement of said slide to said rearward position.

10. A semi-automatic pistol comprising:

a) a frame having a first abutment surface;

b) a slide mounted upon said frame for reciprocal movement with respect thereto between forward and rearward positions and having a second abutment surface substantially parallel to and movable toward said first abutment surface as said slide moves toward said rearward position;

c) a spring urging said slide toward movement to said forward position, said slide moving to said rearward position in response to firing of said pistol;

d) spring guide means including a rod having forward and rear ends, and an integral flange extending radially outwardly from said rod with forward and rear surfaces;

e) a first resilient, impact-absorbing member positioned between said flange rear surface and said first abutment surface to prevent mutual contact thereof; and f) a second, resilient, impact-absorbing member in covering, contacting relation to at least a portion of said flange forward surface between said flange forward surface and said second abutment surface.

11. The pistol of claim 10 wherein said flange comprises a metal layer between said resilient member and said second abutment surface.

12. The pistol of claim 11 wherein each of said resilient members have a thickness greater than the thickness of said metal layer.

13. The pistol of claim 12 wherein the thickness of each of said resilient members is at least about twice the thickness of said metal layer.

14. The pistol of claim 13 wherein the thickness of said metal layer is not more than about 0.050".

15. The pistol of claim 10 and further including a stem portion extending axially outwardly from said guide rod rear end, said member and said second member encircling said stem portion and said rod, respectively, on opposite sides of said flange.

* * * * *